US006494213B2

(12) United States Patent
Calafut

(10) Patent No.: US 6,494,213 B2
(45) Date of Patent: Dec. 17, 2002

(54) LUMINOUS NAIL FILE WITH REVEALED INDICIA, MIRROR AND AUDIBLE AND VISUAL OUTPUT DEVICES

(76) Inventor: Edward J. Calafut, 2590 Glen Wood Rd., Vestal, NY (US) 13850

( * ) Notice: Subject to any disclaimer, the term of this patent is extended or adjusted under 35 U.S.C. 154(b) by 0 days.

(21) Appl. No.: 09/855,601

(22) Filed: May 16, 2001

(65) Prior Publication Data

US 2002/0166566 A1 Nov. 14, 2002

Related U.S. Application Data

(63) Continuation-in-part of application No. 09/551,857, filed on Apr. 18, 2000.

(51) Int. Cl.[7] ..... A45D 29/18; A45D 29/04; B24D 15/00

(52) U.S. Cl. ..... 132/76.4; 132/75.6; 132/73.5; 451/523

(58) Field of Search ..... 132/76.4, 73, 75.8, 132/76.5; 451/523, 530, 533, 539

(56) References Cited

U.S. PATENT DOCUMENTS

| | | | | |
|---|---|---|---|---|
| 4,459,987 A | | 7/1984 | Pangburn | 51/392 |
| 4,534,138 A | | 8/1985 | Pangburn | 128/355 |
| 4,927,483 A | | 5/1990 | Bray | 156/306.6 |
| 5,036,561 A | | 8/1991 | Calafut | 15/105 |
| 5,109,637 A | | 5/1992 | Calafut | 51/391 |
| 5,567,520 A | | 10/1996 | Neckermann | 428/402 |
| 5,666,981 A | | 9/1997 | Stephens | 132/76.4 |
| 6,062,967 A | * | 5/2000 | Calafut et al. | 451/523 |
| 6,145,512 A | * | 11/2000 | Daley | 132/76.4 |

* cited by examiner

*Primary Examiner*—Nicholas D. Lucchesi
*Assistant Examiner*—Robyn Kieu Doan
(74) *Attorney, Agent, or Firm*—Siemens Patent Services, LC

(57) ABSTRACT

The present invention provides a slightly bendable nail file which has indicia in the form of a pictorial image. The file comprises a flexible foamed synthetic resin core sandwiched between paperboard panels, at least one of which is of a luminescent material. At least one paperboard panel has a layer of transparent grit bonded thereto. At least one paperboard panel also has an image formed thereon, the image being outwardly visible through the transparent grit. The second paperboard panel may optionally have a mirror coating. A sound chip, light emitting diode (LED), or image projector may optionally be imbedded in the foam core for enhanced audible and visual messaging.

21 Claims, 3 Drawing Sheets

LUMINOUS NAIL FILE WITH REVEALED INDICIA, MIRROR AND AUDIBLE AND VISUAL OUTPUT DEVICES

REFERENCE TO RELATED APPLICATION

This application is related to Ser. No. 09/045,956, filed on Mar. 23, 1998 and issued as U.S. Pat. No. 6,062,967, on May 16, 2000; and is a Continuation-In-Part of Ser. No. 09/551,857, filed Apr. 18, 2000.

BACKGROUND OF THE INVENTION

1. Field of the Invention

The present invention relates to flat, hand held files of the type generally employed for abrading finger nails and the like. More particularly, the invention comprises a file having indicia disposed thereon, with transparent grit or abrasive disposed over the indicia, with at least one of its two opposing sides having a luminescent surface. The indicia is revealed through the transparent grit. The file may be employed in conventional fashion while displaying the indicia without obstruction from the grit both in its original condition and after it has been employed for abrading. The luminescent surface provides a novel glow in the dark aspect to the file, providing both entertainment value and a convenient method of locating the file in a dimmed lighting situation. The invention is useful both in professional and consumer applications wherever cosmetic products and procedures are utilized.

2. Description of the Prior Art

Finger nail files are generally purely utilitarian devices intended for abrading finger nails. They generally comprise planar members having a rough surface suitable for abrading finger nails. Finger nail files are generally fabricated in one of two ways. The file may be formed from a stratum of metal, such as steel, which is scored or otherwise treated to have a roughened or abrasive surface.

While steel files are durable, they typically lack flexibility. Flexibility imparts an ability to conform to a body surface. Conformity enables a more even polishing to be achieved. Flexible finger nail files have been provided in the prior art by forming the file from parallel strata including a flexible core stratum and surrounding strata fabricated from materials suitable for carrying abrasive in the form of grit of predetermined fineness.

Flexible nail files or similar implements are seen in U.S. Pat. Nos. 4,459,987 and 4,534,138, issued to William E. Pangburn respectively on Jul. 17, 1984, and Aug. 13, 1985, U.S. Pat. No. 4,927,483, issued to David Bray on May 22, 1990, and U.S. Pat. No. 5,666,981, issued to Dallas H. Stephens on Sep. 16, 1997, as well as in my prior U.S. Pat. No. 5,036,561, issued Aug. 6, 1991, and U.S. Pat. No. 5,109,637, issued May 5, 1992. U.S. Pat. No. 5,567,520, issued to Edwin F. Neckermann on Oct. 22, 1996, describes translucent or transparent grit. However, none of these patents shows or suggests use of indicia on a nail file, much less indicia revealed in or behind transparent or translucent grit, or incorporating a mirror into a nail file, these being characteristics of the present invention.

None of the above inventions and patents, taken either singly or in combination, is seen to describe the instant invention as claimed.

SUMMARY OF THE INVENTION

The present invention provides a nail file displaying indicia on at least one broad face. In a preferred embodiment, at least one face displaying indicia also bears abrasive grit. The grit is transparent or translucent, so as to reveal the indicia below. Additionally, at least one of the two opposing faces of the nail file is formed of a luminescent, printable material. The face of the nail file therefore performs three functions, those of displaying indicia, emitting light and also bearing a roughened surface for abrading. The file may also incorporate a mirror or buffing and polishing grits on the side opposite that bearing abrasive grit. This feature enables consumers and cosmetologists to perform multiple cosmetic functions utilizing one apparatus.

Indicia may take any form, such as a flat pictorial image, holographic image or imprinted data. The data may convey messages relating to advertising, instructions, identity of the manufacturer, purpose, or characteristics of the file. A pictorial or holographic image, if provided, may convey a theme establishing a marketing identity, illustrating method of use, or merely suggesting a self-image appropriate for persuading consumers to purchase or use the file.

The file is preferably of the flexible type, so that it may conform to a finger nail or to a curved surface of any object being polished or abraded. The file is formed from a flexible synthetic resin core sandwiched by two paper or similar outer strata.

Accordingly, it is one object of the invention to provide an abrasive file which displays indicia.

A second object of the invention is to provide a luminescent surface as part of a file.

A further object of the invention is to display indicia from a surface bearing abrasive material.

It is another object of the invention that the file be flexible.

It is a further object of the invention to convey data or information on the abrasive face of a file.

Still another object of the invention is to provide transparent or translucent abrasive material on the file.

Yet another object of the invention is to provide a mirror as part of the file.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
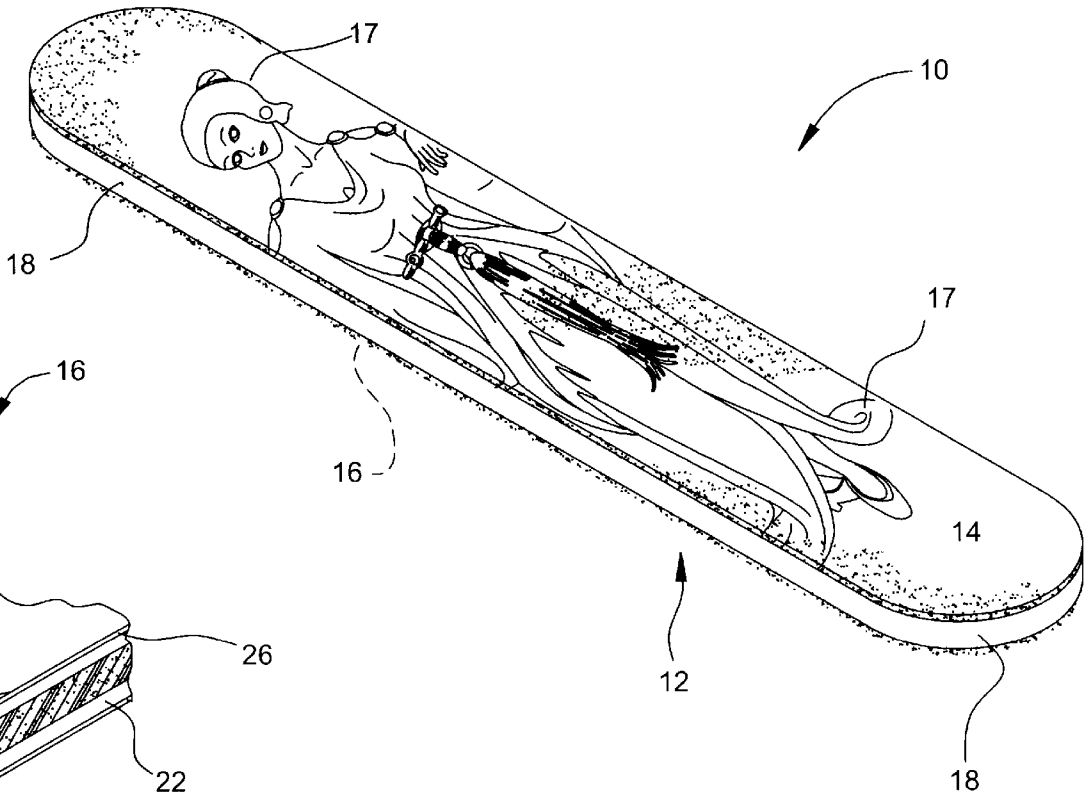
FIG. 1 is a perspective view of one embodiment of the invention.

Turning now to FIG. 1 of the drawings, file 10 is seen to comprise a generally planar body 12 having a front face 14, a rear face 16, and lateral edges 18 disposed between and spacing apart front and rear faces 14, 16. The thickness of body 12, which correlates to width of edges 18, is only nominal, in that the thickness is sufficient to impart a measure of rigidity to body 12 depending upon characteristics of the constituency of body 12.

Body 12 is partially flexible. This signifies that body 12 is sufficiently rigid to allow manual pressure to be imposed on file 10 without causing file 10 to bend to the point that it is not usable as an abrading or polishing implement. At the same time, the outer surface of body 12 can flex to a limited degree, so that faces 14, 16 are no longer planar. Rather, they become slightly curved to conform to a small extent to the surface being abraded or polished. This characteristic is useful when filing and polishing finger nails and similar curved surfaces, since it assures that contact is made on a broad area rather than at the point of tangential contact which would occur if file 10 were absolutely rigid.

Indicia 17 is disposed upon front face 16. Indicia 17 may be a pictorial image, such as a photograph or a holographic image, or may be printed matter. The precise nature of indicia 17 is not important, although it is preferred that indicia 17 convey information. A photograph or holograph conveys a theme which the manufacturer, seller, or user of file 10 may wish to have a consumer associate with file 10. Illustratively, when indicia 17 depicts a comely human model, a client of a beauty salon may come to associate that salon or a vendor of file 10 with a self-image promoting use of nail 10 or patronizing the salon furnishing or employing file 10. Of course, indicia 17 may contain subject matter of another type, such as instructions for use, names identifying the manufacturer or distributor of file 10. Photographs of travel destinations could also be used to create a functional souvenir item.

Figure 2:
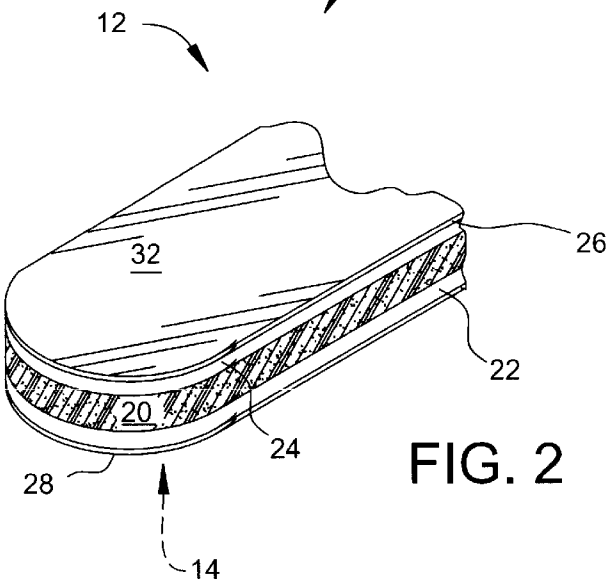
FIG. 2 is a perspective detail view of the embodiment of FIG. 1.

Clearly shown in FIG. 2, body 12 comprises a core 20 of flexible foamed synthetic resin, a first stratum 22 of bendable solid material disposed between core 20 and front face 14, and a second stratum 24 of bendable solid material disposed between core 20 and rear face 16. Constituent material of strata 22, 24 may be paper or a like material which accepts printing inks, and to which a bonding agent will bond. Strata 22 and/or 24 may, optionally, be of a printable, luminescent material. Indicia 17 is formed as a layer 26 of ink or inks deposited on strata 22 and/or 24 of bendable material. In lieu of luminescent strata 22 and/or 24, a layer 26 of luminescent ink or a luminescent thread 30 may be used in conjunction with non-luminescent strata 22 and/or 24 to create a luminescent indicia 17. Luminescent thread 30 could optionally be a fiber optic thread, as will be discussed later.

Indicia 17 is disposed on body 12 beneath a transparent or translucent abrasive surface 28. The abrasive surface is formed in any suitable way such that it both functions as an abrasive and also reveals indicia 17. Optionally, to minimize cost, the picture seen through the surface of the abrasive can be obtained by printing a reversal on the back side of the abrasive 28. The image then can be seen through the top surface of the abrasive eliminating the printed paper of stratum 22 and/or 24 and double stick clear tape (not shown).

Abrasive surface 28 which coats face 14 and/or rear face 16 and is the outermost component of front face 14 and/or rear face 16 is preferably small or finely ground grit particles embedded in a matrix including a bonding agent. It would be evident to one skilled in the art that abrasive surface 28 could be created by applying a spray adhesive to strata 22 and/or 24 and applying the grit to the sprayed adhesive. It is important, however, that the grit and bonding agent both be selected from those which are transparent or translucent, so that they enable indicia 17 to be visible or revealed through abrasive surface 28.

It would be further evident to one skilled in the art that while one abrasive surface 28 may contain a smoothing grit, a second abrasive surface 28 could be divided into two regions, one composed of a buffing grit and the second composed a polishing grit, thus providing a full range of nail finishing abrasives in a single file.

Optional stratum 32 is formed from a material displaying a mirror coating. Suitable materials for providing stratum 32 include synthetic films with or without adhesive. The mirrored coating may be non-chromatic, as is typical of silvered mirrors, or alternatively may be chromatic. If chromatic, the coating may be monochromatic or polychromatic. If polychromatic, the different hues may be in discrete zones, zones displaying gradual transition from one hue to the next, or may be arranged in the form of indicia and images. Examples of suitable films include cellulose acetate, polyester, polyvinyl chloride, as manufactured by GRAFIX Plastics, a division of GRAFIX, Inc., Cleveland, Ohio 44128.

Optionally, to reduce cost, a thicker mirror can be used in replacement of the foamed synthetic resin core 20 of FIG. 2, thereby eliminating the synthetic resin core 20 and the double stick foam required to bond the mirror to the foamed synthetic resin.

These materials as well as those of body 12 can be formed by die cutting. Therefore, an advantageous method of fabrication includes forming body 12 and adhering stratum 32 to sheets of stock material (not shown). File 10 is formed by die cutting the stock material.

Figure 3:
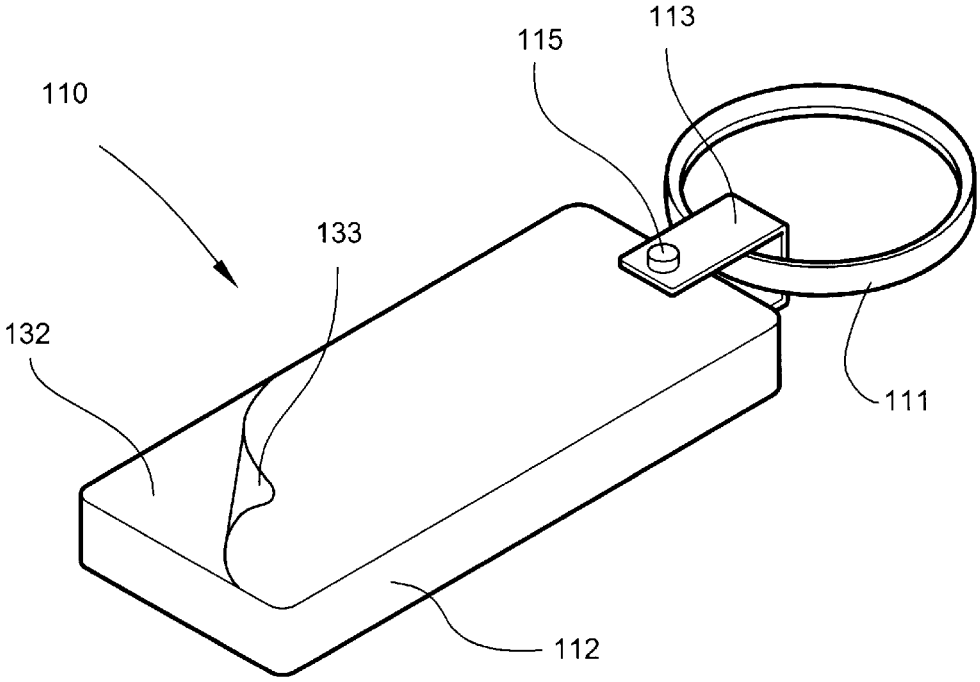
FIG. 3 is a perspective view of another embodiment of the invention.

In another embodiment, shown in FIG. 3, file 110 is generally similar to the embodiment of FIG. 1, but has an attachment ring 111 attached thereto by engagement with a retaining strap 113. Strap 113 is attached to body 112 by a rivet 115 or other suitable fastener.

Optionally, stratum 132, which is similar to stratum 32 of the embodiment of FIG. 2, is covered by a transparent or translucent liner 133 which is dimensioned and configured to overlie stratum 132 precisely. Liner 133 may be fabricated from a film which is retained to stratum 132 by static electrical charge, or alternatively may be coated with adhesive (not shown).

File 10 is usable in the manner of conventional finger nail files, but adds a dimension of performance by virtue of conveying the message of indicia 17 to the user and also affording the convenience of a mirror.

Figure 4:
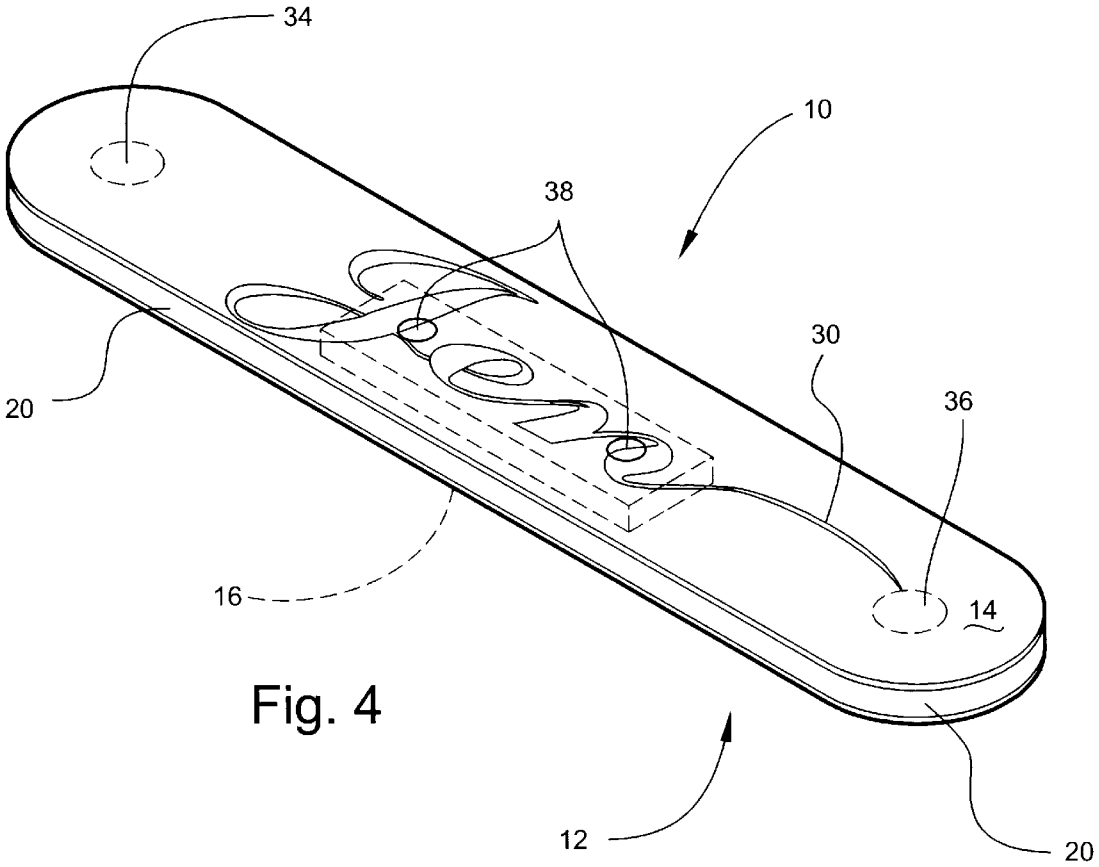
FIG. 4 is a perspective view of the invention including optional, added details.

As illustrated in FIG. 4, in additional embodiments of file 10, alternative embodiments could contain a variety of novel features, as are known in the art, imbedded into core 20, such as, but not limited to: a sound chip 34 capable of presenting varied audible messages; a light emitting diode with memory chip 36, light emitting diode 36 illuminating one or more fiber optic thread 30; or a single or multi-lens image projector 38 capable of projecting a moving or holographic image.

The present invention is susceptible to modifications and variations that may be introduced thereto without departing from the inventive concept. For example, indicia may be superimposed on the exterior of the abrasive surface of any embodiment of the invention. In still another alternative, the grit or the bonding agent or both may be impregnated with indicia. In a further alternative, the abrasive surface may be provided in a form other than that employing grit and bonding agent. For example, it may comprise a rough, open celled foam, an abraded metal substrate, or still other compositions.

Although the preferred embodiment has been described in detail, it is to be understood that the present invention is not limited to the embodiments described above, but encompasses any and all embodiments within the scope of the following claims.

What is claimed is:

1. A nail file having revealed indicia, comprising:

a generally planar body of nominal thickness, having a front face, a rear face, and lateral edges disposed between said front face and said rear face;

an abrasive surface disposed upon at least one of said front face and said rear face, wherein said abrasive surface comprises small transparent particles of abrasive grit and a transparent bonding agent, indicia disposed upon at least one of said front face and said rear face, wherein said indicia is located entirely below said adhesive surface between said generally planar body and said abrasive surface, said indicia being visible through said particles of abrasive grit and said transparent bonding agent; and an attachment ring attached thereto.

2. A nail file having revealed indicia comprising:

a generally planar body having a nominal thickness, and a front face, a rear face, and lateral edges disposed therebetween, said generally planar body comprising a core of flexible foamed synthetic resin, a first stratum of bendable solid material disposed between said core and said front face, and a second stratum of bendable solid material disposed between said core and said rear face, said generally planar body thus being partially flexible;

an abrasive surface disposed upon at least one of said front face and said rear face, wherein said abrasive surface comprises small particles of transparent abrasive grit and a transparent bonding agent securing said abrasive grit to said face;

indicia printed on at least one of said front face and said rear face between said stratum of bendable solid material and said abrasive surface, wherein said indicia is visible through said transparent abrasive grit and said transparent bonding agent;

wherein a face opposite said indicia bearing face comprises a mirror; and a removable liner disposed in overlying relation to said mirror.

3. A nail file having revealed indicia, comprising:

a generally planar body of nominal thickness, having a front face, a rear face, and lateral edges disposed between said front face and said rear face;

an abrasive surface disposed upon at least one of said front face and said rear face, wherein said abrasive surface comprises small transparent particles of abrasive grit and a transparent bonding agent; and indicia disposed upon at least one of said front face and said rear face, wherein said indicia is located entirely below said adhesive surface between said generally planar body and said abrasive surface, said indicia being visible through said particles of abrasive grit and said transparent bonding agent wherein said generally planar body comprises:

a core of flexible foamed synthetic resin, a first stratum of bendable solid material disposed between said core and said front face, and a second stratum of bendable solid material disposed between said core and said rear face, at least one of said first stratum and said second stratum further comprising a luminescent material, said generally planar body thus being partially flexible wherein said second stratum comprises a mirror coated material; and wherein said indicia comprises an image.

4. A nail file with reveal indicia, as defined in claim 3 wherein said image comprises non-luminescent inks.

5. A nail file with reveal indicia, as defined in claim 3 wherein said image comprises luminescent inks.

6. A nail file with reveal indicia, as defined in claim 3 wherein said image comprises at least one luminescent thread.

7. A nail file having revealed indicia, comprising:

a generally planar body of nominal thickness, having a front face, a rear face, and lateral edges disposed between said front face and said rear face;

an abrasive surface disposed upon at least one of said front face and said rear face, wherein said abrasive surface comprises small transparent particles of abrasive grit and a transparent bonding agent; and indicia disposed upon at least one of said front face and said rear face, wherein said indicia is located entirely below said adhesive surface between said generally planar body and said abrasive surface, said indicia being visible through said particles of abrasive grit and said transparent bonding agent;

wherein said generally planar body comprises:

a core of flexible foamed synthetic resin, a first stratum of bendable solid material disposed between said core and said front face, and a second stratum of bendable solid material disposed between said core and said rear face, at least one of said first stratum and said second stratum further comprising a luminescent material, said generally planar body thus being partially flexible wherein said second stratum comprises a mirror coated material;

a removable liner disposed in overlying relation to said mirror coated stratum; and wherein said indicia comprises an image.

8. A nail file with reveal indicia, as defined in claim 7 wherein said image comprises non-luminescent inks.

9. A nail file with reveal indicia, as defined in claim 7 wherein said image comprises luminescent inks.

10. A nail file with reveal indicia, as defined in claim 7 wherein said image comprises at least one luminescent thread.

11. A nail file having revealed indicia, comprising:

a generally planar body of nominal thickness, having a front face, a rear face, and lateral edges disposed between said front face and said rear face;

an abrasive surface disposed upon at least one of said front face and said rear face, wherein said abrasive surface comprises small transparent particles of abrasive grit and a transparent bonding agent; and indicia disposed upon at least one of said front face and said rear face, wherein said indicia is located entirely below said adhesive surface between said generally planar body and said abrasive surface, said indicia being visible through said particles of abrasive grit and said transparent bonding agent wherein said generally planar body comprises:

a core of flexible foamed synthetic resin, a first stratum of bendable solid material disposed between said core and said front face, and a second stratum of bendable solid material disposed between said core and said rear face, at least one of said first stratum and said second stratum further comprising a luminescent material, said generally planar body thus being partially flexible;

wherein said second stratum comprises a mirror coated material, wherein said indicia comprises an image; and messaging means.

12. A nail file having revealed indicia, as defined in claim 11, wherein said image comprises non-luminescent inks.

13. A nail file having revealed indicia, as defined in claim 11, wherein said image comprises luminescent inks.

14. A nail file having revealed indicia, as defined in claim 11, wherein said image comprises at least one luminescent thread.

15. A nail file having revealed indicia, as defined in claim 11, wherein said messaging means is a sound chip embedded in said generally planar body.

16. A nail file having revealed indicia, as defined in claim 11, wherein said messaging means is a memory chip and light emitting diode imbedded in said generally planar body, said light emitting diode operatively connected to at least one fiber optic thread, said at least one fiber optic threaded adapted for forming an image.

17. A nail file having revealed indicia, as defined in claim 11, wherein said messaging means is an imaging projector imbedded in said generally planar body, said image projector having at least one lens for projecting said image.

18. A nail file having revealed indicia comprising:

a generally planar body having a nominal thickness, and a front face, a rear face, and lateral edges disposed therebetween, said generally planar body comprising a core of flexible foamed synthetic resin, a first stratum of bendable solid material disposed between said core and said front face, and a second stratum of bendable solid material disposed between said core and said rear face, said generally planar body thus being partially flexible;

an abrasive surface disposed upon at least one of said front face and said rear face, wherein said abrasive surface comprises small particles of transparent abrasive grit and a transparent bonding agent securing said abrasive grit to said face;

indicia printed on at least one of said front face and said rear face between said stratum of bendable solid material and said abrasive surface, wherein said indicia is visible through said transparent abrasive grit and said transparent bonding agent; and messaging means.

19. A nail file having revealed indicia, as defined in claim 18, wherein said messaging means is a sound chip embedded in said generally planar body.

20. A nail file having revealed indicia, as defined in claim 18, wherein said messaging means is a memory chip and light emitting diode imbedded in said generally planar body, said light emitting diode operatively connected to at least one fiber optic thread, said fiber optic thread adapted for forming an image.

21. A nail file having revealed indicia, as defined in claim 18, wherein said messaging means is an imaging projector imbedded in said generally planar body, said image projector having at least one lens for projecting said image.

* * * * *